United States Patent [19]

Wilkinson et al.

[11] Patent Number: 4,887,790

[45] Date of Patent: Dec. 19, 1989

[54] TROCHE MOLD AND DISPENSER

[75] Inventors: William R. Wilkinson; Marion G. Webber, both of Houston; Dean J. King, Sugar Land, all of Tex.

[73] Assignee: Professional Compounding Centers of America, Inc., Sugarland, Tex.

[21] Appl. No.: 223,705

[22] Filed: Jul. 22, 1988

Related U.S. Application Data

[63] Continuation of Ser. No. 70,394, Jul. 7, 1987, abandoned.

[51] Int. Cl.[4] ..... A61J 3/06

[52] U.S. Cl. ..... 249/52; 206/531; 206/539; 206/561; 206/828; 220/22; 249/121; 249/122; 249/127; 249/132; 249/142; 249/170

[58] Field of Search ..... 249/121, 126, 127, 129, 249/132, 134, 170, 52, 122, 125, 142; 206/531, 538, 539, 561, 562, 563, 828; 220/22

[56] References Cited

U.S. PATENT DOCUMENTS

| | | | |
|---|---|---|---|
| Re. 17,278 | 4/1929 | Copeman | 249/120 |
| Re. 17,279 | 4/1929 | Copeman | 249/120 |
| D. 135,419 | 4/1943 | Wade | D6/361 |
| 259,364 | 6/1882 | Cauhapé | 217/18 |
| 1,268,920 | 6/1918 | Bots | 312/209 |
| 1,381,487 | 6/1921 | Maruny et al. | 206/528 |
| 1,688,887 | 10/1928 | Spreen | 249/128 |
| 1,726,732 | 9/1929 | Doran | 206/45.15 |
| 1,777,483 | 10/1930 | Copeman | 249/127 |
| 1,803,028 | 4/1931 | Menten | 206/528 |
| 1,879,602 | 9/1932 | Copeman | 249/130 |
| 1,894,897 | 1/1933 | Tinkham | 62/72 |
| 1,935,405 | 11/1933 | Leyner | 249/127 |
| 1,945,605 | 2/1934 | Geyer | 249/120 |
| 2,004,525 | 6/1935 | Geyer et al. | 249/127 |
| 2,011,244 | 8/1935 | Hannaford | 249/132 |
| 2,257,377 | 9/1941 | Haben | 249/126 |
| 2,433,211 | 12/1947 | Gits | 249/127 |
| 2,718,326 | 9/1955 | LeBlanc | 220/22.3 |
| 2,834,456 | 5/1958 | Langer | 206/539 |
| 3,111,220 | 11/1963 | Bostrom | 206/539 |
| 3,266,704 | 8/1966 | Deeren | 206/558 |
| 3,346,099 | 10/1967 | Thomas et al. | 206/539 |
| 3,412,572 | 11/1968 | Kesling | 62/344 |
| 3,429,426 | 2/1969 | Wolf et al. | 206/539 |
| 3,552,595 | 1/1971 | Gerner et al. | 206/539 |
| 3,703,955 | 11/1972 | Inacker | 206/532 |
| 3,743,084 | 7/1973 | Douglas | 206/539 |
| 3,807,551 | 4/1974 | Ankney | 206/539 |
| 3,807,601 | 4/1974 | Frankenberg | 221/289 |
| 3,844,525 | 10/1974 | Parmett | 249/127 |
| 3,898,855 | 8/1975 | Curfhey | 62/75 |
| 4,023,768 | 5/1977 | Herrera-Casasus | 249/81 |
| 4,038,937 | 8/1977 | Möe | 116/121 |
| 4,039,080 | 8/1977 | Cappuccilli | 206/534 |
| 4,050,188 | 9/1977 | van Wingerden | 249/131 |
| 4,081,122 | 3/1978 | Hobson | 249/127 |
| 4,093,103 | 6/1978 | Mumford | 220/283 |
| 4,147,324 | 4/1979 | Walter | 249/121 |
| 4,155,198 | 5/1979 | Kelley | 47/84 |
| 4,366,941 | 1/1983 | Harris | 249/121 |
| 4,372,445 | 2/1983 | Keffeler | 206/532 |
| 4,432,529 | 2/1984 | McMillan | 249/52 |
| 4,693,371 | 9/1987 | Malpass | 206/561 |

FOREIGN PATENT DOCUMENTS

| | | | |
|---|---|---|---|
| 2714877 | 10/1978 | Fed. Rep. of Germany | 206/531 |

*Primary Examiner*—James C. Housel
*Attorney, Agent, or Firm*—Vaden, Eickenroht, Thompson & Boulware

[57] ABSTRACT

A combination medication mold and dispenser. The medication is poured into a multicompartment tray and solidifies into troches. The tray is made of a flexible plastic which can be bent to release the troches individually. The tray has a cover attached with a flexible hinge to protect the troches after preparation. The medication can be prepared and dispensed to the patient in the same container. The covered tray can be held in a sleeve to further protect the medication and hold the cover in place.

4 Claims, 1 Drawing Sheet

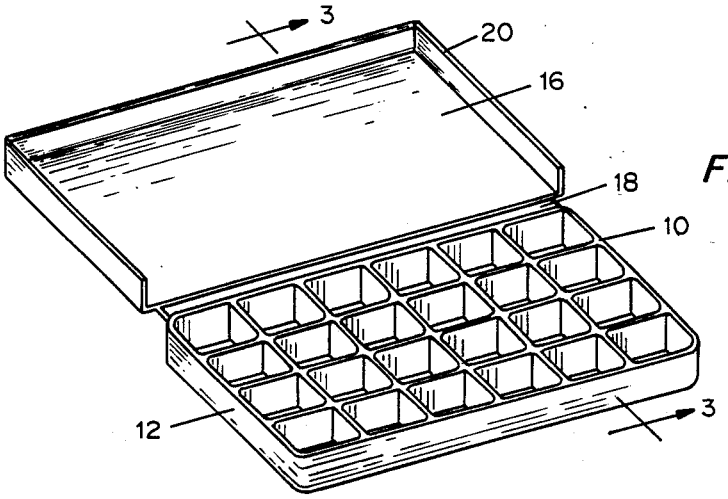
Fig. 1
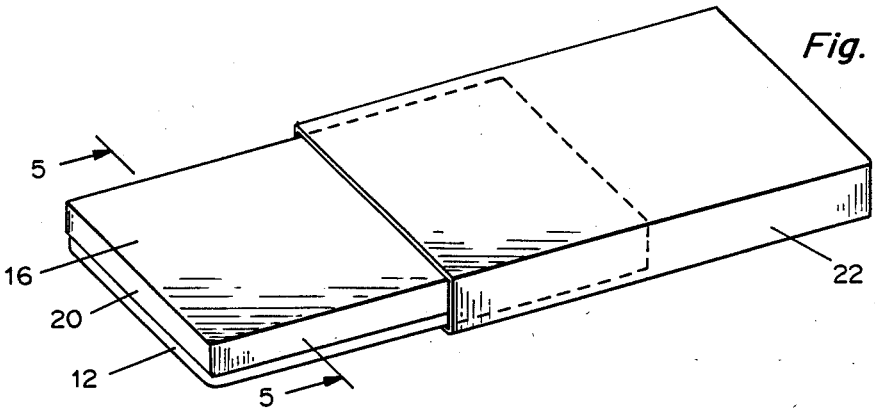
Fig. 2
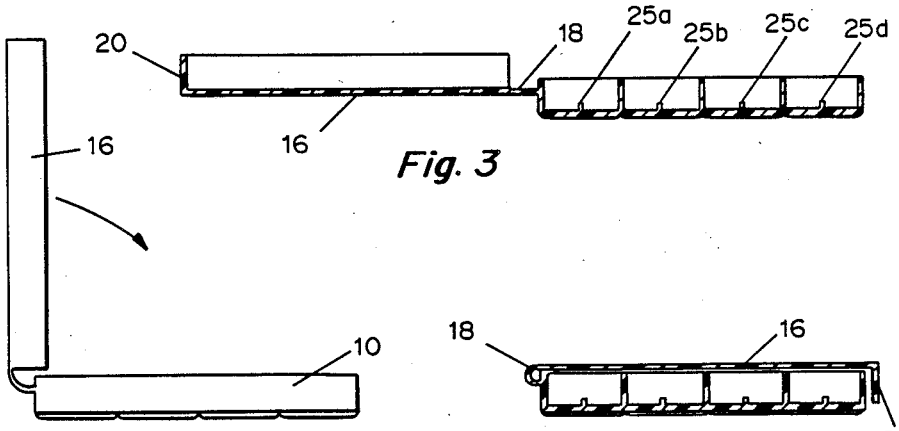
Fig. 3
Fig. 4
Fig. 5

TROCHE MOLD AND DISPENSER

This application is a continuation, of application Ser. No. 07/070,394, filed July 7, 1987, abandoned.

BACKGROUND AND SUMMARY OF THE INVENTION

Troche medications are solid tablet-like lozenges which are placed in the patient's mouth sometimes under the tongue and dissolved. The medication is released as the tablet dissolves. The troches are often individually wrapped. A common example is cough drops.

The troches have been made with various types of apparatus. Some troche preparations are in dough form which are rolled and cut out with an instrument like cookie cutter to form discs. The discs are dried and packaged.

Other oral tablet triturates can be molded or pressed out. One mold type is composed of rigid plate of some depth with circular holes punched in the plate. A liquid medication preparation is poured and spread in the holes of the plate. When the medication has dried, the tablets are removed. A plate with pegs to match the holes in the mold plate can be used to punch out the tablets. The methods and apparatus for preparing oral dosages are well known.

There is a need for preparation of medication in troche form. The troche route is preferred with drugs which are more effectively administered by absorption in the mouth rather than swallowed and absorbed from the gastrointestinal tract. Some drugs are detoxified in the gastrointestinal tract such that the efficacy is diminished. These drugs are much more effective if the route of administration is absorption through the mouth and into the vascular system present in the mouth area. Also, some therapeutic agents such as antihistaminics are more effective delivered in the troche form.

Oral dosages of hormone compounds such as progesterones have been reported to be more effectively administered other than the delivery by a pill in the gastrointestinal tract. Orally administered doses of progesterone that go into the gastrointestinal system are metabolized by the liver. G. Lane, et al., "Dose dependent effect of oral progesterone on the oestrogenised post menopausal endometrium," *British Medical Journal,* 287:1241, Oct. 29, 1983; M. I. Whitehall, et al., "Absorption and Metabolism of Oral Progesterone," *Obstetrical and Gynecological Survey,* 36:32, 1981.

The present invention is a combination medication mold and dispenser which can be used very easily by the pharmacist in preparing troches. The pharmacist can prepare a specific dosage by mixing the active ingredient with a carrier and heating. The liquid is then poured into the mold and allowed to set at room temperature upon which time the troches solidify.

The troche mold and dispenser is a molded plastic multi-compartment tray with a hinged lid. The compartments hold a volumetric controlled amount. The preparation of the troches with the mold requires no special tools or equipment for the pharmacist. The mold has a hinged lid which is used to cover the troches when carried by the patient. After the troches have been prepared by the pharmacist they may be dispensed in the mold to the patient.

The mold is of a flexible plastic which can be bent and manipulated to dispense one troche at a time by the patient. The volumetric capacity and shape of the tablet can be varied as desired. The mold can be composed of various number of compartments. The troche mold with the cover in place can be slid into a sleeve to protect the cover from releasing accidentally.

BRIEF DESCRIPTION OF THE DRAWINGS

FIG. 1 is a perspective view of the troche mold and dispenser with the cover open.

FIG. 2 is a view of the troche mold and dispenser covered and its placement into a sleeve.

FIG. 3 is a cross-sectional view of the troche mold and dispenser with the cover open.

FIG. 4 shows the cover closure of the troche mold and dispenser.

FIG. 5 is a cross-sectional view of the troche mold and dispenser with the cover placed over the tray.

DESCRIPTION OF THE PREFERRED EMBODIMENT

The troche mold and dispenser is made of a material that has flexibility such as molded plastic. As shown in FIG. 1, the troche mold and dispenser is composed of a tray 10 with multiple compartments or cavities. The tray has a side wall 12 which extends upward from the flat bottom section 14. The cavities are formed by an intersecting grid of flexible plastic walls. The compartments on the outer perimeter of the tray have walls which are formed in part by side wall 12.

The size of the compartments can be adjusted by the spacing on the grid walls. The compartments are generally of the identical volumetric measurement.

As shown in FIG. 1, tray 10 contains a grid work of intersecting walls within side wall 12 that are the identical volumetric size. In some cases the grid walls could be adjusted so that the compartments are different volumetric capacities.

As shown in FIG. 1, tray 10 is connected to cover 16 by flexible hinge 18. Hinge 18 is a strip of flexible plastic attached on one side of rectangular side wall 12 and on the other side to cover 16. Cover 16 is sized to fit over the top of tray 10 to completely cover the contents of the tray. Cover 16 has an overhang edge 20 extending around three sides of the cover which are not attached to the hinge. When the cover is placed over the tray, the overhang overlaps the side wall 12.

FIG. 2 shows the troche mold and dispenser covered with the cover 16 folded at hinge 18 to protect the contents of tray 10. The covered tray is shown sliding into sleeve 22 and part of the troche mold and dispenser is shown in phantom. The sleeve is used to protect the accidental opening of the cover 16 and is optional.

FIG. 3 shows a cross-sectional view of the troche mold and dispenser shown in FIG. 1. The compartments may have raised linear protrusions **25*a*, 25*b*, 25*c* and 25*d*, for example, which extend through the length of each compartment in the middle of the compartment. FIG. 3 also shows the hinge section 18 connecting the cover 16 to tray 10**.

FIG. 4 shows a perspective view of the cover closing over tray 10. The overhang 20 of cover 16 fits closely to side wall 12. When hinge 18 is in the folded position as shown in FIG. 5, the cover 16 remains in closed position over the tray 10.

FIG. 5 shows a cross-section of the closed troche mold and dispenser with cover 16 in the closed position. FIG. 5 also shows the hinge 18 in fully folded position.

When a pharmacist needs to extemporaneously compound a medication in troche form, he will prepare the medication in a liquid form usually with some heating of the composition. The warm liquid will be poured into the troche mold and dispenser of this invention so that the medication fills each of the cavities evenly in the grid work of the tray. The even filling of the cavities of a uniform liquid will provide the patient with a constant dosage per troche when the compartments are identical volumetric capacities.

The medication solidifies or sets at room temperature. The cover 16 is closed over tray 10 and if desired is placed into a sleeve such as illustrated in FIG. 2 for additional protection. The small linear protrusions 25*a*, 25*b*, 25*c* and 25*d* in the center of each of the cavities as illustrated in FIG. 3 are used to produce an indentation to score the troche if it is desired to provide a simple means to break the troche in half.

The troche mold and dispenser is made of flexible material such as plastic. The tray has sufficient flexibility so that the patient may bend or manipulate the bottom or sides of each compartment and release a selected troche. The shape of the compartments and size of the compartments can be altered according to the shape and size of the desired troche. A generally flat rectangular troche shaped in the form of the cavity shown in FIG. 1 is comfortable for sublingual dissolution.

The material used to make the mold and dispenser can be color coded to indicate medication type. The troche mold and dispenser is easy to carry by the patient without contamination from the environment.

The illustrations in the drawings are a representative embodiment of this invention and are not intended to limit the invention as claimed.

What is claimed is:

1. A combination medication mold and dispenser comprising a flexible, bendable molded plastic multicompartment tray of a grid matrix with compartments formed by intersecting flexible walls with each compartment sized for an oral medicine troche and said tray made of a plastic capable of receiving a warm liquid poured into the compartments for molding into a solid troche with the bottom of each compartment having a small linear protrusion to produce an indentation to score the troche;

a cover for said multicompartment tray; and a flexible hinge connecting said multicompartment tray and said cover to open and close to protect the contents of said tray.

2. A combination medication mold and dispenser of claim 1 including a sleeve sized for the covered tray to slide inside the sleeve.

3. A combination medication mold and dispenser comprising a multicompartment tray of a flexible, bendable molded plastic grid matrix array with compartments formed by intersecting flexible walls forming generally rectangular compartments each sized to contain a volumetric amount suitable for an oral troche;

said multicompartment tray of flexible plastic which can be bent to release selectively a solid troche medication held in the compartment and said tray made of a plastic capable of receiving a warm liquid poured into the compartments for molding into a solid troche with the bottom of each compartment having a small linear protrusion to produce an indentation to score the troche;

a cover which fits over the tray;

a flexible hinge of a plastic strip connecting the length of one side of said tray and the length of one side of the cover; and said cover having overhang edges extending from the cover to surround the sides of the tray not connected to the hinge to provide an overlap closure when the tray is covered.

4. A combination medication mold and dispenser of claim 3 having a rectangular sleeve sized to enclose the covered tray to maintain the cover of said tray in a closed position and sized so that the tray may slide in and out of the sleeve.

* * * * *